United States Patent [19]

Moss

[11] 4,084,683

[45] Apr. 18, 1978

[54] RIBBON TRACKING SYSTEM

[75] Inventor: James R. Moss, Lum, Mich.

[73] Assignee: Computer Peripherals, Inc., Rochester, Mich.

[21] Appl. No.: 778,767

[22] Filed: Mar. 17, 1977

[51] Int. Cl.[2] ..... B41J 35/04

[52] U.S. Cl. ..... 197/170; 197/151; 226/190; 226/196; 242/157 R; 29/116 R; 198/806

[58] Field of Search ..... 197/151, 170; 226/190, 226/192, 196; 242/76, 157 R; 29/110–116 R, 116 AD; 26/101; 198/806

[56] References Cited

U.S. PATENT DOCUMENTS

| | | | |
|---|---|---|---|
| 2,960,749 | 11/1960 | Robertson et al. | 29/116 R |
| 3,227,281 | 1/1966 | Peterson et al. | 26/101 |
| 3,393,849 | 7/1968 | Hass | 226/196 |
| 3,825,103 | 7/1974 | Riley | 197/160 |
| 3,829,040 | 8/1974 | Nelson | 226/190 |
| 3,874,030 | 4/1975 | Knight | 242/157 R |
| 3,884,623 | 5/1975 | Slack | 29/122 |

OTHER PUBLICATIONS

Lentz, *Adjustable Ribbon Tracking Device,* IBM Technical Disclosure Bulletin, vol. 16, No. 6, p. 1751, 11/73.

*Primary Examiner*—William Pieprz
*Attorney, Agent, or Firm*—J. T. Cavender; Wilbert Hawk, Jr.; George J. Muckenthaler

[57] ABSTRACT

A ribbon tracking system includes guide means and roller means thereon which automatically tilts in the proper direction to correct for errors in tracking of the ribbon. A crowned pulley is floatingly supported and journaled on a curved guide post or shaft wherein the pulley is caused to be axially moved along the post or shaft by reason of corrective forces, in a direction opposite the tracking error for correcting the attitude of the ribbon.

9 Claims, 5 Drawing Figures

RIBBON TRACKING SYSTEM

BACKGROUND OF THE INVENTION

In high speed printing operations, it is desirable that the inking ribbon utilized therein be driven and controlled in a manner whereby long life of the ribbon is accomplished by subjecting as much of the ribbon surface as possible to the printing operation. While many drum type printers use a pair of spools or mandrels to carry a ribbon of near drum width in a path past the printing station and in a direction coinciding with rotation of the drum (and also including the ribbon reversal direction), the band type printer uses a ribbon of lesser width which is carried on spools in a manner wherein the ribbon is driven in a path coinciding with the driving direction of the band (again including the ribbon reversal direction). In this respect it is also desirable to utilize the full width of the ribbon, and common practice includes the concept wherein the ribbon spools are positioned in an attitude to cause the ribbon to be driven in a skewed or canted manner past the printing station.

Representative prior art in the drive and control of inking ribbons is disclosed in the following patents. For example, U.S. Pat. No. 3,362,325, issued on Jan. 9, 1968 to W. P. Foster, discloses an endless belt mask journaled around a driving pulley and a driven pulley, the pulleys being crowned to index the belt mask. Additionally, the driven pulley is mounted on a spring loaded base to facilitate insertion and removal of the belt mask. U.S. Pat. No. 3,701,318, issued on Oct. 31, 1972 to P. R. Lozeau et al., shows skew control apparatus for feeding a wide-web ribbon in a high speed printer wherein a photoelectric sensor signals a tracking device which includes a movable shaft having a series of teeth therein which mesh with teeth of a gear rotatable in either direction, and wherein the ribbon alternately tracks along two paths spaced a predetermined distance apart. And, U.S. Pat. No. 3,825,103, issued on July 23, 1974 to A. F. Riley, shows a high speed printer having improved ribbon driving, reversing and tensioning mechanism utilizing ribbon guide rollers each having an arbor with inwardly directed shank portions which merge into a central shank portion. An outer sleeve is mounted in the arbor, the sleeve having an oversize bore which permits the guide rollers to axially move along the arbor for continuous tracking alignment.

SUMMARY OF THE INVENTION

The present invention relates to an inking ribbon in a high speed band printer and more particularly to drive and control mechanism for causing the ribbon to track along a desired path between and around a pair of spaced ribbon spools located adjacent the printing station.

The invention covers a self-correcting or stable ribbon tracking system utilizing guide means and roller means thereon which automatically tilts in the proper direction to correct for any tracking error. The guide means comprises a curved post or shaft carrying a crowned pulley or roller thereon, the crowned pulley being biased by a spring to provide floating action and wherein the pulley is caused to be axially moved along the post or shaft, by reason of corrective forces, in a direction opposite the tracking error for correcting the attitude of the ribbon.

When all the forces acting on the ribbon are balanced and no tracking error exists, the centerline of the ribbon along the length thereof is aligned with the center of the radius of curvature of the guide post or shaft and the floating pulley is centered with respect to the ribbon.

When a tracking error exists due to an unbalance of forces acting on the ribbon, and the centerline of the ribbon does not align with the radius of curvature of the guide post, the forces on the crowned, floating pulley cause the pulley to center itself with respect to the ribbon. As the pulley moves axially along the curved guide post, the curvature of such post causes the pulley to tilt in a direction opposite the forces responsible for the tracking error and a restoring force on the pulley and the ribbon results in a stable ribbon tracking system.

While the above-mentioned spring may provide bias on the pulley to compensate for the effect of gravity in a vertically-directioned construction, a counterbalance may be utilized to likewise compensate for the gravity effect. When the guide post or shaft is oriented in a horizontally directed position, the pulley is likewise axially moved along the curved post or shaft by the forces on the ribbon, the movement of the pulley along the curved post resulting in a corrective action between the post and the pulley to cause the pulley and ribbon to be returned to a desired position for proper tracking of the ribbon.

In accordance with the above discussion, the principal object of the present invention is to provide means for correcting errors in ribbon tracking.

Another object of the present invention is to provide ribbon guide means having a curvature along which a ribbon pulley is axially moved to compensate for ribbon tracking errors.

An additional object of the present invention is to provide ribbon guide means wherein a crowned pulley is caused to be moved along a curved shaft by restorative forces to compensate for errors in ribbon tracking.

A further object of the present invention is to provide means for utilizing the maximum width of an inking ribbon while correcting any tracking errors during the driving of the ribbon.

Additional advantages and features of the present invention will become apparent and fully understood from a reading of the following description taken together with the annexed drawings, in which.

Figure 1:
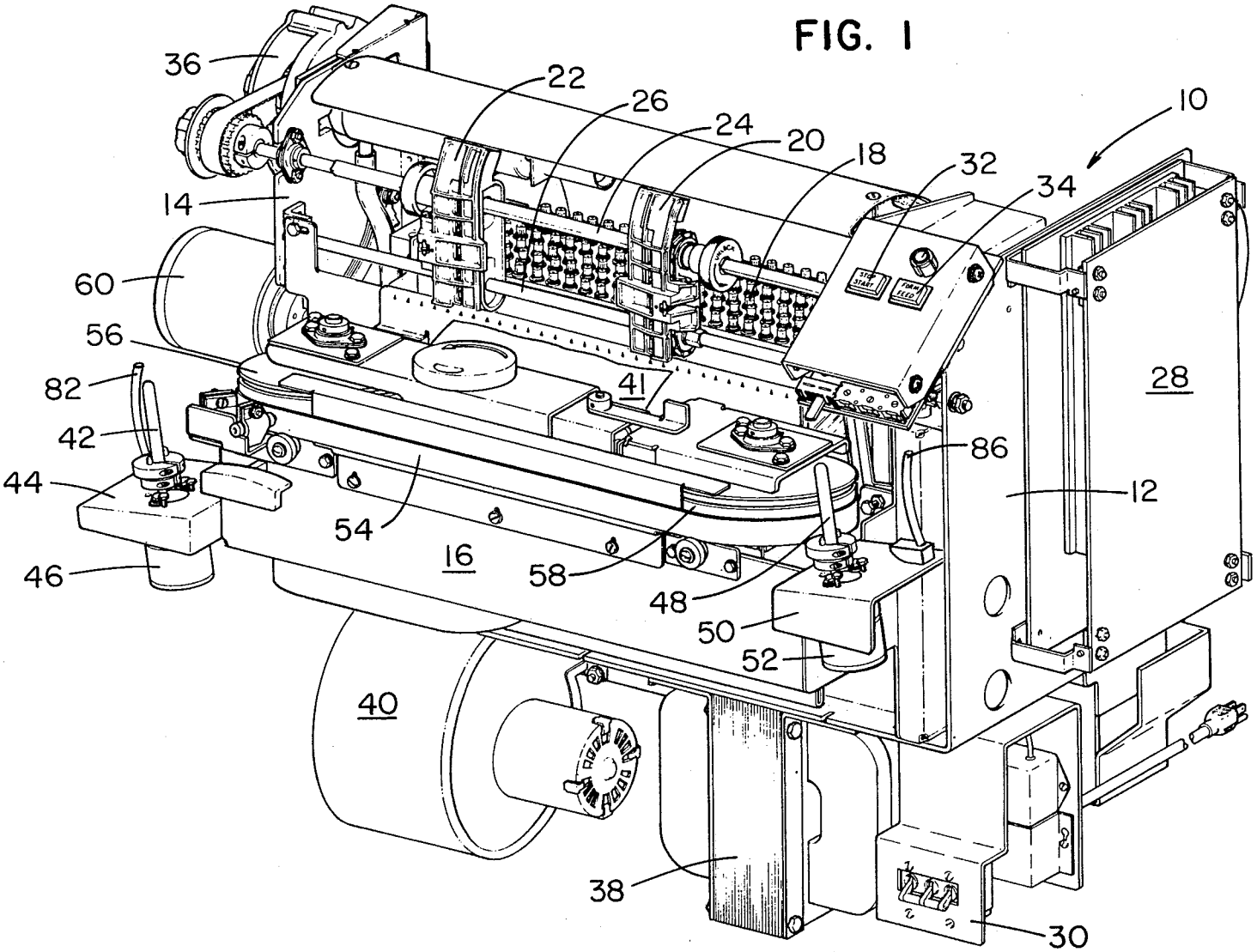
FIG. 1 is a right front perspective view of a portion of a printer with which the subject matter of the present invention may be utilized.

As seen in FIG. 1, a printer 10 incorporating the subject matter of the present invention utilizes a band for carrying the type characters thereon, such band printer distinguishing from a drum printer in a number of areas and features, the most significant area being the type carrying structure. The printer 10, of course, includes the framework of vertical side plates 12 and 14, which support the print band gate structure 16, the hammer bank 18, the paper forms tractors 20 and 22 carried on shafts 24 and 26, the power supply and servo drive 28, and other major parts which will be explained later in further detail. An on-off switch 30 is located at the lower right front of the printer, a start-stop switch 32 and a forms feed switch 34 are positioned on the top right front of the printer, and forms handling control mechanism 36 is located on the upper left side of the printer 10. A transformer 38 and a blower unit 40 are disposed under the gate structure 16, the blower unit providing cooling to the various areas and parts of the printer.

Form paper or like record media 41 is caused to be driven or pulled by the tractors 20, 22 from a forms stack below the gate structure 16, upwardly past the printing station between a type band 54 and the hammer bank 18, and out an exit slot at the rear of the printer. A ribbon (not shown in FIG. 1) is caused to be driven from a ribbon spool rotatable on a spindle 42 which is supported on a frame member 44 and driven by a motor 46 located at the left side of the gate structure 16, the ribbon being guided in a path rearward of the gate structure and onto a ribbon spool rotatable on a further spindle 48 which is supported on a frame member 50 and driven by a motor 52 at the right side of the gate structure 16.

The print or type band 54 is caused to be driven in a counter-clockwise direction by the drive pulley 56, at the left side of the gate structure 16, and around a driven or idler pulley 58 located at the right side of the structure 16, the band 54 being directed in a path adjacent a platen (not shown) and past a print station and positioned to be impacted by print hammers aligned in a horizontal manner forward of the hammer bank 18. A hammer bank drive motor 60 is provided for driving or moving the hammer bank in a horizontal direction for purposes not relevant to the subject matter of the present invention.

For purposes of information, the print band support mechanism, the forms handling control mechanism, and the paper forms clamping mechanism include structures which are the subject matter of copending applications, assigned to the same assignee as the present application.

Figure 2:
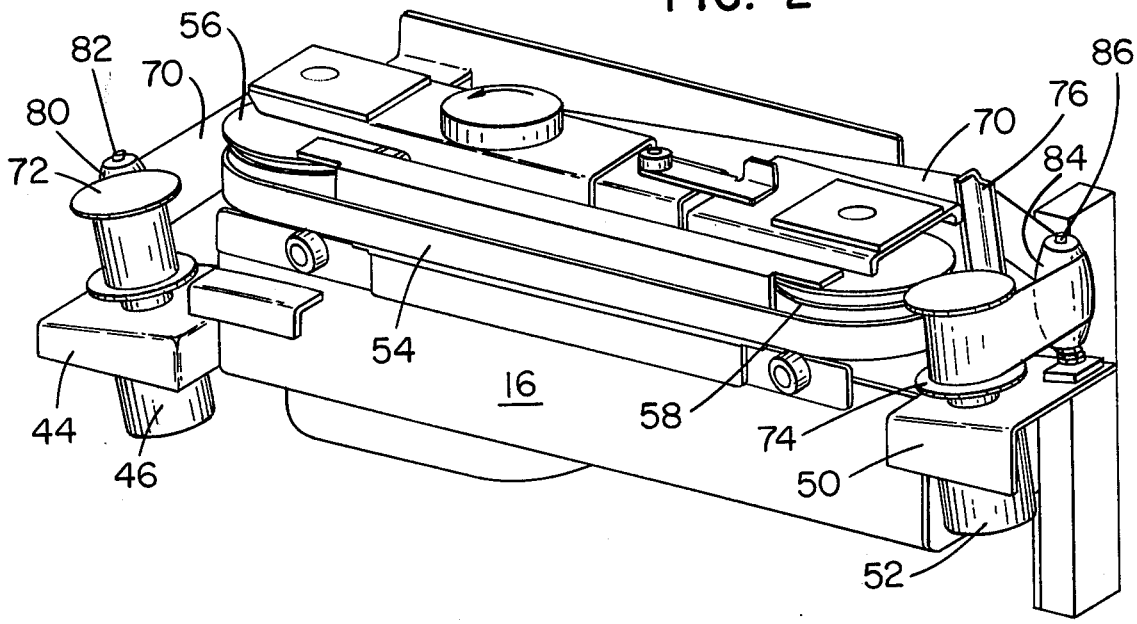
FIG. 2 is a perspective view of a portion of the structure shown in FIG. 1 with the inking ribbon carried thereon.

FIG. 2 shows a perspective view of a portion of the structure of FIG. 1 and includes an inking ribbon 70, specifically dimensioned as two inches wide and 43 yards long, which has one end thereof attached to and carried by a ribbon spool 72 on the spindle 42 at the left side of the gate structure 16 and has the other end attached to and carried by a ribbon spool 74 on the spindle 48 at the right side of the gate structure. Of course, the motors 46 and 52 provide drive means for the ribbon 70, such motors being of the reversible type so that the ribbon can be reversed in direction of travel for longer ribbon life. The ribbon 70 is caused to be driven, in the unwinding thereof, from the ribbon spool 72, past the print station in a slightly inclined or slanted angle of 5 degrees from the horizontal and in a path of sufficient length for printing a full line at one time, and then driven for winding the ribbon onto the spool 74. A pair of ribbon guide members 76 (only one shown) are disposed at respective sides of the print station for causing the ribbon 70 to be guided in a path parallel to and along the planes of the print hammers and the print band 54.

A crowned floating pulley or roller 80 is journaled on a guide post or shaft 82 (FIG. 2), the shaft having a curvature along the length thereof in one direction and supported from the frame member 44 at the left side of the gate structure 16 (FIG. 1), and a like crowned floating pulley or roller 84 is journaled on a guide post or shaft 86 (FIG. 2) having a like curvature and supported from the frame member 50 at the right side of the gate structure (FIG. 1). The surface of each roller or pulley 80, 84 is generally convex by definition as viewed from the position of the ribbon 70, e.g. the surface 85 of roller 84 (FIG. 3) having a curvature wherein normals at neighboring points diverge in relation to the ribbon, or alternatively, generally concave by definition as viewed from the axis of the roller, the surface of such roller having a curvature wherein normals at neighboring points converge in relation to the axis of the roller. A light spring 88 is used on the underside of each pulley to compensate for the effect of gravity when the ribbon pulleys are presented vertically in a ribbon 70 system operating in a substantially horizontal attitude, per FIGS. 2 and 3.

Figure 3:
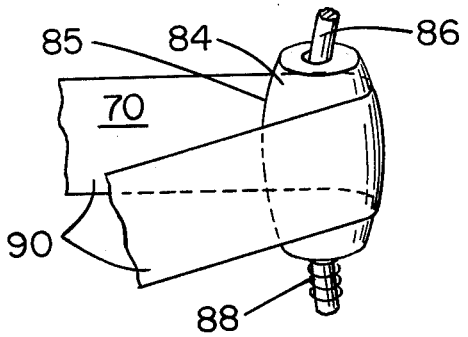
FIG. 3 is an enlarged view of spring biased tracking means with the inking ribbon thereon.

More particularly, FIG. 3 shows an enlarged view of the crowned pulley 84 on the curved guide post or shaft 86 wherein it can be seen that the crowned pulley 84 operates in a self-tracking manner on the curved post 86. Such self-tracking is made possible by reason that the bore of the pulley 84 has a larger diameter than the diameter of the curved shaft 86 to permit the pulley to easily move a limited distance along the curvature of the shaft 86. When all the forces on the ribbon system are balanced and there is no ribbon tracking error, the centerline of the ribbon lines up with the center of the radius of curvature of the post 86 and the pulley 84 is centered with respect to the ribbon 70. When an error is presented in the tracking system and the centerline of the ribbon 70 does not line up with the center of the radius of curvature of the guide post 86, the forces causing such tracking error of the ribbon 70 on the crowned pulley 84 cause such pulley, along with the ribbon, to be moved along the curved post 86.

A tracking error in the path of ribbon travel may be caused by forces due to the proximity of the ribbon 70 to the paper 41 when the paper is being driven in an upwardly direction thus tending to also move the ribbon in said direction, the error may be caused by the print load or vector forces of the print hammers striking against the ribbon 70, or the error may be caused by defects in the material or weave of the ribbon 70 thereby resulting in uneven forces across the width of the ribbon in its travel past the print station. As again seen in FIG. 3, if such unbalanced forces on the ribbon 70 cause the ribbon to be moved in the upward direction, the ribbon moves upward on the curved surface 85 of the crowned pulley 84, the lower portion 90 of the ribbon on the greater or increased diameter of the pulley causing an increased tension in that portion of the ribbon and thus causing the pulley to be moved upwardly on the curved shaft 86 in response to such unbalanced forces on the system. The curvature of the shaft 86 engaging with the greater inside diameter of the pulley 84 enables such pulley to move a limited distance along the shaft but then resists or limits upward movement of the pulley on the shaft wherein the pulley 84 is tilted in one direction from a substantially straight attitude and the increased tension in the ribbon 70 along the upper edge of the ribbon resulting from tilting of the pulley then causes the pulley to be moved downwardly on the shaft along with the ribbon moving to the center of the pulley in a corrective position of the tracking path of the ribbon. The pulley 84 is thus automatically returned in a direction opposite the direction of the unbalanced forces on the ribbon 70 to a position wherein the ribbon is again centered on the pulley and the pulley is centered on the curvature of the shaft 86. In other words, as the pulley 84 moves with the ribbon 70, the curved guide post 86 causes the pulley to tilt in a direction which provides a restoring force on the ribbon, resulting in return of the ribbon along with the pulley to the guide post center position for again providing a stable ribbon tracking system. In this manner the floating pulley 84 is located and caused to be moved along the curved post 86 by the ribbon 70 and the tension in the ribbon at points across the width thereof. Since the crowned pulley 84 has a dimension along its axis greater than the two inch wide ribbon 70, such ribbon can move as a result of such forces along a path not centered on the pulley or on the curve of the post 86. An error in tracking tends to cause the pulley 84 to center on the ribbon 70, whereby movement of the pulley 84 along the post 86 results in an angle change between the ribbon and the pulley. When the tension in the ribbon 70 at the lower edge portion 90 results in a tracking error whereby the crowned pulley is caused to be moved to a position above the center of the radius of curvature of the post 86, a tracking correction force is exerted on the ribbon 70 in the downward direction and the crowned pulley 84 is caused to be moved downwardly along the curved post 86 where the pulley 84 will be centered with respect to the centerline of the ribbon 70.

Figure 4:
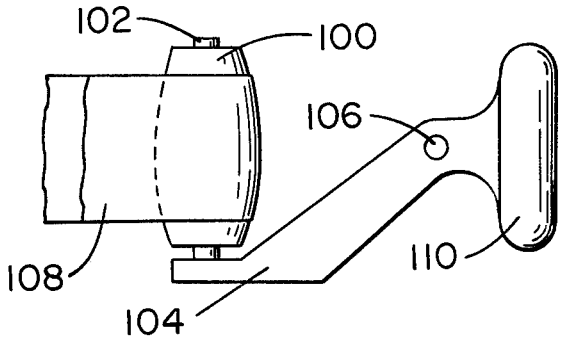
FIG. 4 is a view of counterbalanced tracking, as a modification of the invention, for the inking ribbon.

In FIG. 4 is shown a modification of the ribbon tracking means wherein a pulley 100 is journaled on a post or shaft 102 attached to one end of an arm 104 carried on a pivot pin 106, the pulley being crowned to provide self tracking of a ribbon 108. A counterbalance or counterweight 110 is utilized on the opposite side of the pivot pin 106 from the pulley 100 to balance the effects of gravity on the shaft 102 and roller 100 in a manner wherein such counterweight substitutes for the spring 88 in FIG. 3 and thereby aids in supporting and correcting any error in tracking of the ribbon 108 as it is driven in a path past the print station. The counterweight 110 would be of a predetermined value equal to and balancing the weight of a portion of the arm 104 and its supported parts, minus the effect of forces from the ribbon 108 around the pulley 100. Assuming an upward force on the ribbon 108 which causes the ribbon to move upon the surface of the pulley 100, the movement of the ribbon also causes the pulley to move up on the shaft 102. However, after a limited distance such upward movement of the ribbon 108 is arrested by increased tension along the upper edge of the ribbon riding on the larger diameter of the roller 100 and the roller is caused to be moved downwardly to a position where the roller is again centered on the ribbon.

Figure 5:
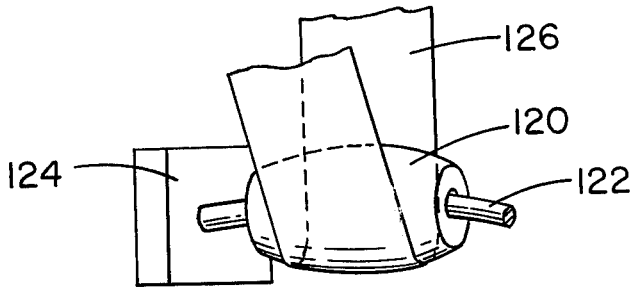
FIG. 5 is a similar view as FIG. 3 with the tracking means in a horizontal position.

While the ribbon 70 shown in FIG. 2 is carried by the spools 72 and 74 in a manner wherein the ribbon is horizontally positioned as it is driven past the print station, a modification of the printer structure may use a ribbon which travels in a vertical plane past the station. FIG. 5 shows a crowned pulley 120 journaled on a curved post or shaft 122 attached at one end thereof to a support member 124 wherein, in the manner previously described, the pulley 120 is caused to travel a limited distance axially along the post 122 by any unbalanced forces on a ribbon 126 as the ribbon seeks the correct tracking position.

It is thus seen that herein shown and described is a tracking system for an inking ribbon which includes a crowned pulley and supporting structure permitting self-correction for any tracking errors of the ribbon. The apparatus enables the accomplishment of the objects and advantages mentioned above, and while modifications of the invention have been disclosed herein, still other variations may occur to those skilled in the art. It is contemplated that all such variations, not departing from the spirit and scope of the invention hereof, are to be construed in accordance with the following claims.

What is claimed is:

1. A tracking system for maintaining a ribbon, movable in a direction along a line of printing, in a desired attitude comprising a roller engaging said ribbon and having a bore therethrough, a shaft journaling said roller, said shaft being of a diameter smaller than the diameter of said bore and having a curvature extending therealong, said roller having an axial dimension greater than the width of said ribbon and said ribbon and said roller being axially movable in one direction along said shaft in response to unbalanced forces on said ribbon, and axially movable in the other direction to the desired attitude, and means balancing the gravity effect on said roller.

2. The tracking system of claim 1 comprising a pair of crowned pulleys carried by respective shafts and there is provided means for driving said ribbon from one pulley past the line of printing to the other pulley.

3. The tracking system of claim 1 wherein said shaft is disposed in a generally vertical direction and includes spring means for biasing said roller in an upwardly direction along said shaft.

4. Apparatus for maintaining an inking ribbon in a path to provide proper tracking of the ribbon, said apparatus including a guide post, a roller journaled on said guide post, said roller having a ribbon carrying surface defining a shape along the length thereof in which normals at neighboring points converge in relation to the axis of said roller, said roller having an axial dimension greater than the width of said ribbon and being axially movable along said guide post and said ribbon being movable along the length of said ribbon carrying surface upon unbalance of forces on said ribbon in one direction, the movement of said ribbon along the increased diameter of said surface causing said roller to move along said guide post, the increased tension of said ribbon on said surface causing said roller to be moved in a direction opposite the unbalanced force direction to cause said ribbon to be corrected in its tracking along said path, and means balancing the gravity effect on said roller.

5. The apparatus of claim 4 wherein said guide post includes a curvature therealong and said roller defines a bore therethrough of greater diameter than the diameter of said guide post.

6. A tracking system for a ribbon in a printer having type characters movable along a line of printing, hammer means for impacting against said type characters in printing operations, and means for moving said ribbon in a path along said line of printing, said tracking system including a pair of guide posts positioned at the respective ends of said line of printing to provide a path for said ribbon between said hammer means and said type characters, a roller journaled on each of said guide posts, said roller providing a ribbon bearing surface of a shape in which normals at neighboring points converge in relation to the axis of said roller, each of said guide posts having a curvature in one direction therealong and said roller being axially movable along the curvature of said guide post in response to unbalance of forces acting on said ribbon and thereby cause said ribbon to error in tracking along said path, the movement of said roller along said guide post correcting said error in tracking to establish the proper path of said ribbon, and means balancing the gravity effect on said roller.

7. The tracking system of claim 6 wherein each of said guide posts is disposed in a generally vertical direction and includes spring means for biasing said roller in an upwardly direction along said guide post.

8. In a printer having a printing element carrying a plurality of type characters thereon, means for driving said element for presenting said characters along a line of printing, hammer means for impacting against the type characters on said element, a ribbon movable in a direction along said line of printing in a path between said hammer means and said type character printing element, and means for maintaining said ribbon in a desired attitude including a shaft positioned adjacent one end of the line of printing, a roller journaled on said shaft, said shaft having a predetermined diameter and including a curvature in one direction therealong, and said roller having an inside diameter greater than the diameter of said shaft and an outside diameter presenting a ribbon carrying surface around which said ribbon is trained, said surface defining a shape in which normals at neighboring points converge in relation to the axis of said roller, and said roller being axially movable along said shaft in response to unbalanced forces acting on said ribbon, the movement of said roller along said shaft being restrained by the curvature thereof and restored to a central location along said shaft in response to differences in tension in said ribbon across the width thereof in relation to the surface of said roller and means balancing the gravity effect on said roller.

9. In the printer of claim 8 wherein said shaft is disposed in a generally vertical direction and includes spring means for biasing said roller in an upward direction along said shaft.

* * * * *